US007399947B2

(12) United States Patent
Rassatt et al.

(10) Patent No.: US 7,399,947 B2
(45) Date of Patent: Jul. 15, 2008

(54) THERMAL PROCESSOR WITH TEMPERATURE COMPENSATION

(75) Inventors: Bradley B. Rassatt, Apple Valley, MN (US); David J. McDaniel, Lino Lakes, MN (US)

(73) Assignee: Carestream Health, Inc., Rochester, NY (US)

( * ) Notice: Subject to any disclaimer, the term of this patent is extended or adjusted under 35 U.S.C. 154(b) by 0 days.

(21) Appl. No.: 11/502,162

(22) Filed: Aug. 10, 2006

(65) Prior Publication Data

US 2008/0047951 A1 Feb. 28, 2008

(51) Int. Cl.
*G03D 13/00* (2006.01)
*H05B 1/02* (2006.01)

(52) U.S. Cl. ..... 219/469; 219/216; 399/69; 399/279; 399/286; 430/350

(58) Field of Classification Search ..... None
See application file for complete search history.

(56) References Cited

U.S. PATENT DOCUMENTS 5,191,362 A 3/1993 Ichikawa
5,361,088 A 11/1994 Ito et al.
5,768,655 A 6/1998 Yoshino et al.
5,946,025 A 8/1999 Allen
5,990,461 A * 11/1999 Stumpf et al. ..... 219/216
6,297,476 B1 * 10/2001 Kashino et al. ..... 219/216
6,811,333 B2 * 11/2004 Sumi et al. ..... 219/216

FOREIGN PATENT DOCUMENTS

EP 1 383 005 A1 1/2004

* cited by examiner

*Primary Examiner*—Joseph M Pelham

(57) ABSTRACT

A thermal processor including a rotating drum including an internal heater configured to heat and maintain the drum at a desired set-point temperature, and a plurality of pressure rollers, including a first pressure roller, circumferentially spaced along a segment of the drum. A temperature sensor is configured to provide a temperature signal indicative of a temperature proximate to the first pressure roller. A controller is configured to adjust the desired set-point temperature based on the temperature signal.

20 Claims, 5 Drawing Sheets

THERMAL PROCESSOR WITH TEMPERATURE COMPENSATION

FIELD OF THE INVENTION

The present invention relates generally to an imaging apparatus, and more specifically to a thermal processor for thermally developing an imaging material employing temperature compensation.

BACKGROUND OF THE INVENTION

Photothermographic film generally comprises a base material, such as a thin polymer or paper, typically coated on one side with an emulsion of heat sensitive materials. Once the film has been subjected to photostimulation, such as via a laser of a laser imager, for example, a thermal processor is typically employed to develop the resulting latent image through application of heat to the film. In general, a thermal processor raises the base material and emulsion to an optimal development temperature and holds the film at the development temperature for a required time period to develop the image. To provide optimal and consistent quality in developed images, a thermal processor must perform this heating operation smoothly and consistently within a single film and between multiple films.

One type of processor for thermally developing photothermographic is typically referred to as a drum processor. One type of drum processor employs an internally heated rotating drum having a series of non-heated pressure rollers positioned around a segment of the drum's surface. During development, rotation of the drum draws the photothermographic film between the drum and the pressure rollers, with the pressure rollers holding the film, typically the emulsion-side, in contact with the drum as the film moves through the processor. As it moves through the processor, heat is transferred to the film and it is heated to an optimal development temperature to develop the latent image.

While heat is transferred to the photothermographic film primarily from the heated drum, some heat is also transferred to the film from the non-heated pressure rollers. During idle times, when film is not being processed, the pressure rollers are in direct contact with and absorb heat from the heated drum. As film passes between the drum and pressure rollers during processing, a portion of this heat is transferred to the film. At low film throughput (i.e. the number of films processed in a given time period), heat transfer from the pressure rollers typically does not pose a problem as heat transferred to given sheet of film is recovered through contact with the drum between sheets so that the temperature of the rollers does not significantly drop.

However, at higher film throughput (such as continuous film feed, for example), the pressure rollers are not able to recover heat from the drum between films, and the temperature of the rollers, particularly those which make first contact with the film, decreases with successive films until an equilibrium or steady state temperature is reached. Consequently, earlier films of a series of films being processed have different temperature profiles and absorb more heat than later films of the series, resulting in uneven densities of the developed images between films of the series.

In view of the above, there is a continuing need for improved photothermographic film developers. In particular, there is a need for a thermal processor that reduces variations in image density resulting from variations in roller temperatures as described above.

SUMMARY OF THE INVENTION

In one embodiment, the present invention provides thermal processor including a rotating drum having an internal heater configured to heat and maintain the drum at a desired set-point temperature, and a plurality of pressure rollers, including a first pressure roller; circumferentially spaced along a segment of the drum. A temperature sensor is configured to provide a temperature signal indicative of a temperature proximate to the first pressure roller, and a controller is configured to adjust the desired set-point temperature based on the temperature signal. In one embodiment, the temperature signal is indicative of a temperature of the first pressure roller.

By adjusting the desired set-point temperature at which the heater maintains the drum based on a temperature proximate to the first pressure roller, a thermal processor according to embodiments of the present invention more consistently heats successive sheets of imaging media and substantially reduces image density variations resulting from changes in temperature of the pressure rollers during processing of a run of exposed sheets of imaging media.

BRIEF DESCRIPTION OF THE DRAWINGS

The foregoing and other objects, features, and advantages of the invention will be apparent from the following more particular description of the embodiments of the invention, as illustrated in the accompanying drawings. The elements of the drawings are not necessarily to scale relative to each other.

DETAILED DESCRIPTION OF THE INVENTION

Figure 1:
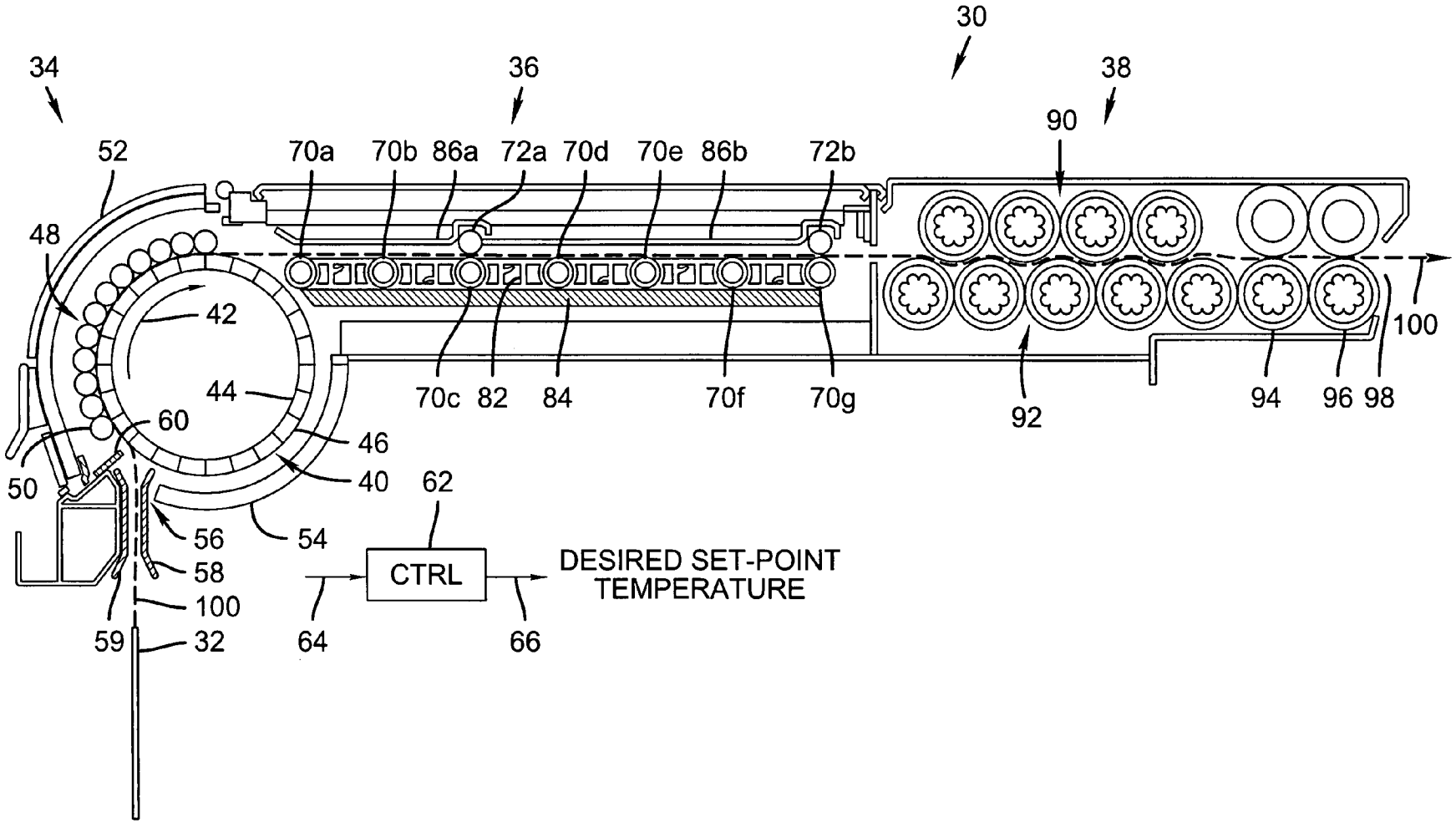
FIG. 1 is a block illustrating generally an imaging apparatus employing temperature compensation according to embodiments of the present invention.

FIG. 1 is a cross-sectional view illustrating generally portions of one example embodiment of a thermal processor 30 for thermally developing an image in an imaging media, such as imaging media 32. Imaging apparatus 30 includes a drum-type processor 34 employing temperature compensation according to embodiments of the present invention, a flatbed type processor 36, and a cooling section 38. In one embodiment, drum-type processor 34 heats imaging media 32 from an ambient temperature to a desired pre-dwell temperature, at which point imaging media 32 is transferred to flatbed type processor 36. In one embodiment, the desired pre-dwell temperature is substantially equal to a development temperature associated with imaging media 32. Flatbed type processor 36 maintains imaging media 32 at the development temperature for a desired development time, or dwell time, after which it is cooled to an output temperature by cooling section 38.

Figure 2:
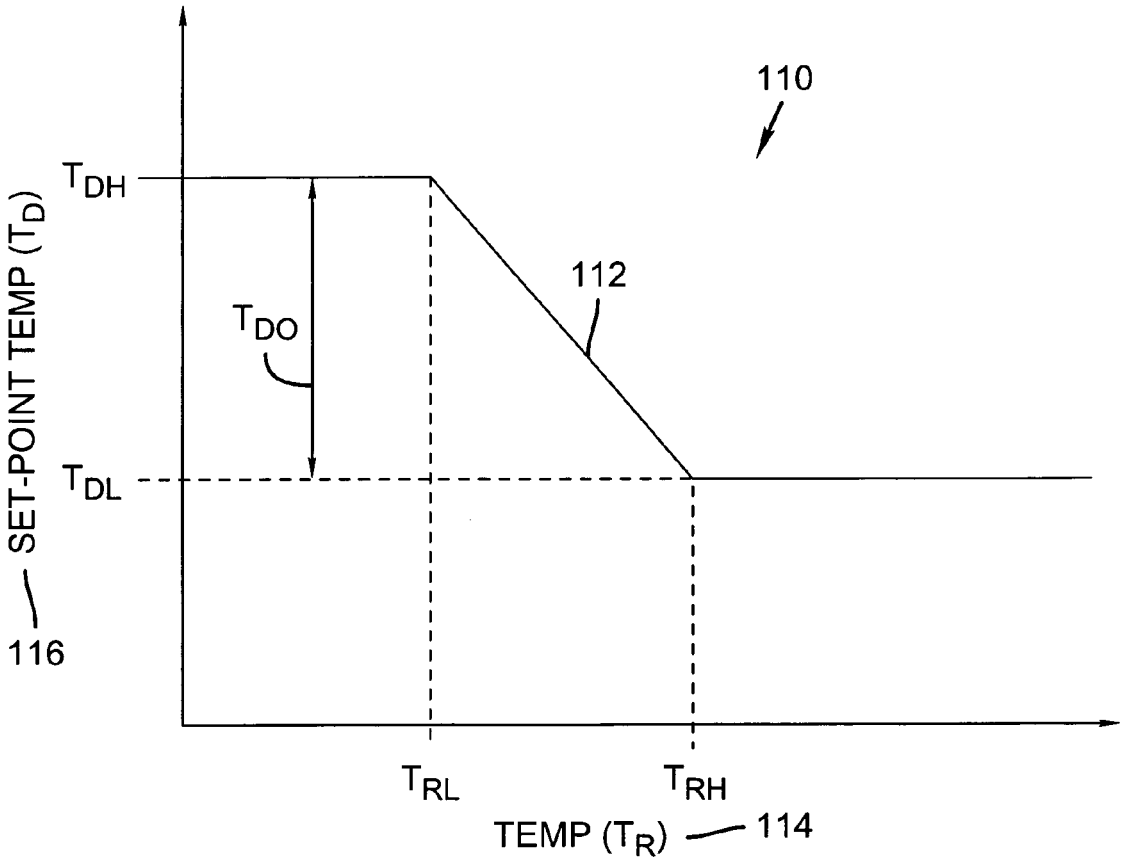
FIG. 2 is a graph illustrating desired set-point temperature of a drum-type thermal of the imaging apparatus of FIG. 1.

In one embodiment, as illustrated by FIG. 2, drum-type processor includes a processor drum 40 that is driven so as to rotate in a direction as indicated by directional arrow 42. A circumferential heater 44 (e.g., a blanket heater) is mounted within an interior of processor drum 40 and is configured to heat and maintain processor drum 40 at a desired set-point temperature such that drum-type processor 34 heats imaging media 32 to the development temperature before being transferred to flatbed type processor 36. In one embodiment, processor drum is coated with a layer of silicon rubber 46. A plurality of pressure rollers 48, including a first pressure roller 50, is circumferentially arrayed along a segment of processor drum 40 and configured to hold imaging media 32 in contact with silicon rubber layer 46 of processor drum 40 during the development process.

Drum-type processor 34 is enclosed by an upper cover 52 and a lower cover 54 spaced from the plurality of pressure rollers 48 and processor drum 40 and having ends spaced from one another to define an entrance 56. An entrance guide formed by guide plates 58 and 59 is positioned at entrance 56 and configured to direct imaging media 32 to processor drum 40 adjacent to first pressure roller 50.

Drum-type processor 34, according to embodiments of the present invention, includes a temperature sensor 60 and a controller 62. Temperature sensor 60 is positioned proximate to first pressure roller 50 and is configured to provide a temperature signal 64 indicative of a temperature proximate to first roller 50. In one embodiment, temperature sensor 60 is configured to provide a temperature signal 64 indicative of the temperature of first pressure roller 50.

In one embodiment, as illustrated, temperature sensor 60 is mounted to, but thermally isolated from, guide plate 59. In one embodiment, temperature sensor 60 comprises a thermocouple type sensor with a probe tip positioned proximate to first pressure roller 50. In one embodiment, temperature sensor 60 comprises a resistance-type temperature detector (RTD). In one embodiment, temperature sensor 60 comprises an infrared type sensor providing temperature signal 64 directly indicating the temperature of first pressure roller 50.

As will be described below in greater detail, during operation of thermal processor 30, controller 62 receives temperature signal 64 from temperature sensor 60 and adjusts the desired set-point temperature of processor drum 40 based on the level of temperature signal 64. Although described herein primarily as being indicative of a temperature of first pressure roller 50, temperature signal 64 may be indicative of a temperature proximate to first roller 50 such as, for example, an air temperature proximate to first pressure roller 50 and a temperature of another one of the plurality of pressure rollers 48 (e.g., a second pressure roller).

Flatbed type processor 36 includes a plurality of rollers 70, illustrated as rollers 70*a* through 70*g*, positioned in a spaced fashion, with one or more of the rollers 70 so as to transport imaging media 32 through flatbed type processor from drum type processor 34 to cooling section 38. A pair of idler rollers 72, illustrated as 72*a* and 72*b*, are positioned to respectively form a nips with rollers 70*c* and 70*g* to ensure that imaging media 32 maintains contact with rollers 70.

Flatbed type processor 36 further includes a heat plate 82 and a heater 84 (e.g.; a heat blanket). One or more plates 86, illustrated as plates 86*a* and 86*b*, are spaced from and positioned substantially in parallel with heat plate 82 to form an oven through which imaging media 32 is transported by rollers 70. In one embodiment, heat plate 82 and heater 84 are configured with multiple zones such that one zone may deliver more thermal energy than another to imaging media 32.

An example of a thermal processor combining a drum type processor and a flatbed type processor is described by U.S. patent application Ser. No. 11/029,592, entitled "Thermal Processor Employing Drum and Flatbed Technologies", filed on Jan. 5, 2005, which is assigned to the same assignee as the present invention, and is herein incorporated by reference.

Cooling section 38 includes a plurality of upper rollers 90 and a plurality of lower rollers 92 offset from one another and two pairs of nip rollers 94 and 96. At least a portion of the upper and lower plurality of rollers 90 and 92 and one roller of each pair of rollers 94 and 96 are driven so as to transport imaging media 32 through cooling section 38 from flatbed type processor 36 to an exit 98. The upper and lower plurality of rollers 90 and 92 and the pairs of rollers 94 and 96 are configured to absorb heat from imaging media 32 so as to cool imaging media from the desired development temperature at which it is received from flatbed type processor 36 to a desired output temperature at exit 98.

Together, drum-type processor 34, flatbed type processor 36, and cooling section 38 form a transport path 100 (indicated by the dashed line) along which imaging media 32 is moved during processing by thermal processor 30. In one embodiment, as illustrated, transport path 100 is semi-circular in shape about a portion of processing drum 40 in drum type processor 34, substantially planar in shape across rollers 70 through flatbed type processor 36, and corrugated in shape through the upper and lower plurality of rollers 90 and 92 of cooling section 38. An example of a cooling section similar to cooling section 38 is described by U.S. patent application Ser. No. 11/500,227, entitled "Processor For Imaging Media", filed on Aug. 7, 2006, which is assigned to the same assignee as the present invention, and is herein incorporated by reference.

In operation, circumferential heater 44 heats processor drum 40 to the desired set-point temperature as provided by controller 62 at 66. In one embodiment, as described above, controller 62 adjusts the desired set-point temperature of processing drum 40, as provided at 66, based on temperature signal 64 from temperature sensor 60. In one embodiment, controller 62 adjusts the desired set-point temperature within a desired set-point temperature range having a lower temperature level and an upper temperature level.

In one embodiment, the lower temperature level is approximately equal to the desired pre-dwell temperature. In one embodiment, the pre-dwell temperature is within a range from 120 to 130 degrees centigrade (° C.). In one embodiment, the pre-dwell temperature is substantially equal to the development temperature, or dwell temperature, of imaging media 32. In one embodiment, the desired pre-dwell temperature and dwell temperature are equal to 125° C.

In one embodiment, the upper temperature level is offset above the lower temperature level by a predetermined number of degrees. In one embodiment, the upper temperature level is offset from the lower temperature level by 4° C. As such, in one embodiment, when the lower temperature level is set to equal a development temperature of 125° C. associated with imaging media 32 and an offset of 4° C. is employed by thermal processor 30, controller 62 adjusts the desired set-point temperature of processor drum 40 within a range from 125 to 129° C. based on temperature signal 64 provided by temperature sensor 60.

For illustrative purposes, assume a scenario where controller 62 adjusts the desired set-point temperature within a range having a lower temperature level equal to the development temperature of imaging media 32 and an upper temperature level a predetermined offset above the lower temperature level. In one embodiment, controller 62 initially sets the desired set-point temperature to the lower temperature level, in this case, to the development temperature of imaging media 32.

As such, circumferential heater 44 initially heats processing drum 40 to the development temperature. Prior to receiving any sheets of imaging media, such as imaging media 32, the plurality of pressure rollers 48, including first pressure roller 50, are in direct contact with silicon layer 46 and are also heated to the development temperature. As a sheet of exposed imaging media 32 is received and directed to processing drum 40 by guide plates 58 and 59, the rotation of processor drum draws exposed imaging media 32 between pressure rollers 48 and silicon layer 46. As imaging media 32 wraps around and is held against processing drum 40 by pressure rollers 48, thermal energy is transferred to imaging media 32 from processing drum 40 and from pressure rollers 48 thereby heating imaging media 32.

Because the pressure rollers 48 are only passively heated through contact with processor drum 40, pressure rollers 48 begin to cool as imaging media 32 passes between pressure rollers 48 and silicon layer 46 and absorbs heat. When a spacing between consecutive sheets of imaging media 32 being processed by thermal processor 30 is such that pressure rollers 48 are not able to recover lost heat through contact with processing drum 40, the cooling of pressure rollers 48 continues with each successive sheet of imaging media 32 until a substantially steady-state condition is reached. If not compensated for, the cooling of pressure rollers 48 causes successive sheets of imaging media 32 to have different temperature profiles, thereby resulting in successive sheets of imaging media 32 absorbing decreasing amounts of thermal energy and, consequently, having uneven densities in the corresponding developed images.

The cooling of pressure rollers 48 is greatest at first pressure roller 50 since a temperature differential (i.e., $\Delta T$) between imaging media 32 and pressure rollers 48 is greatest at first pressure roller 50. As such, in one embodiment, as described above, temperature sensor 60 provides temperature signal 64 indicative of the temperature of first pressure roller 50. In one embodiment, as one or more sheets of imaging media 32 are processed by thermal processor 30 and the temperature of first pressure roller 50 decreases, controller 62 increases the desired set-point temperature (as provided at 66) and circumferential heater 44 increases the temperature of processor drum 40 to the increased set-point temperature. After a "run" of successive sheets of imaging media has been completed, or if a spacing between sheets of imaging media of a run of sheets is increased, and the temperature of first pressure roller 50 begins to increase from increased contact with processor drum 40, controller 62 decreases the desired set-point temperature of processor drum 40.

In one embodiment, as will be described in greater detail below, controller 62 sets the desired set-point temperature to the lower temperature level of the range when the temperature of first pressure roller 50 is at or above a first threshold temperature level, to the upper temperature level of the range when the temperature level of first pressure roller 50 is at or below a second threshold temperature level (which is less than the first threshold temperature level), and to a level between the upper and lower temperature levels of the range when the temperature level of first pressure roller 50 is between the first and threshold temperature levels.

By adjusting the desired set-point temperature to which circumferential heater 44 heats processing drum 40 based on a temperature which is indicative of the temperature of first pressure roller 50, thermal processor 30 according to embodiments of the present invention more consistently heats successive sheets of imaging media 32 and substantially reduces image density variations resulting from changes in temperature of pressure rollers 48 during processing of a run of exposed sheets of imaging media 32. Additionally, because first pressure roller 50 is proximate to entrance 56, the temperature of first pressure roller 50 is affected by the ambient temperature of the environment in which drum-type processor 34 operates. As such, by adjusting the desired set-point temperature of processing drum 40 based on the temperature of first pressure roller 50, thermal processor 30 also reduces image density variations resulting from ambient temperature variations of the operating environment.

In one embodiment, controller 62 adjusts the desired set-point temperature ($T_D$) of processor drum 40 based on the temperature ($T_R$) of first pressure roller 50 as provided by temperature sensor 60 according to an algorithm expressed by Equation I below:

$$T_D=T_{DL}, \text{ when } T_R \geqq T_{RH};$$

$$T_D=M_{SL}*T_R+B_{INT}, \text{ when } T_{RL}<T_R<T_{RH}; \text{ and}$$

$$T_D=T_{DH}, \text{ when } T_R \leqq T_{RL}; \qquad \text{Equation I:}$$

where:

$T_R$=temperature of first pressure roller 50;

$T_{RH}$=high temperature threshold of first pressure roller 50;

$T_{RL}$=low temperature threshold of first pressure roller 50;

$T_{DL}$=low temperature set-point of processor drum 40;

$T_{DH}$=high temperature set-point of processor drum 40;

$M_{SL}$=slope of set-point temperature curve; and $B_{INT}$=intercept of set-point temperature curve.

The slope ($M_{SL}$) of the set-point temperature curve is expressed by Equation II below:

$$M_{SL}=T_{DO}/(T_{RL}-T_{RH}); \qquad \text{Equation II:}$$

where $T_{DO}$ is the offset between the low temperature set-point ($T_{DL}$) and high temperature set-point ($T_{DH}$) of processor drum 40 as expressed by Equation III below:

$$T_{DO}=T_{DH}-T_{DL}.$$

The intercept ($B_{INT}$) of the set-point temperature curve is express by Equation IV below:

$$B_{INT}=T_{DL}-(T_{RH}*M_{SL}). \qquad \text{Equation IV:}$$

FIG. 2 is a graph 110 of a curve 1 12 illustrating the set-point temperature ($T_D$) of processor drum 40 as a function of the temperature ($T_R$) of first pressure roller 50 as expressed above by Equation I. The temperature ($T_R$) of first pressure roller 50 is illustrated along the x-axis, as indicated at 114, and the set-point temperature ($T_D$) of processor drum 40 is illustrated along the y-axis, as indicated at 116. As illustrated by graph 110, the set-point temperature ($T_D$) of processor drum 40 is equal to $T_{DH}$ when $T_R$ is at or below $T_{RL}$, is equal to $T_{DL}$ when $T_R$ is at or above $T_{RH}$, and decreases linearly from $T_{DH}$ to $T_{DL}$ for increasing values of $T_R$ between $T_{RL}$ and $T_{RH}$.

Figure 3:
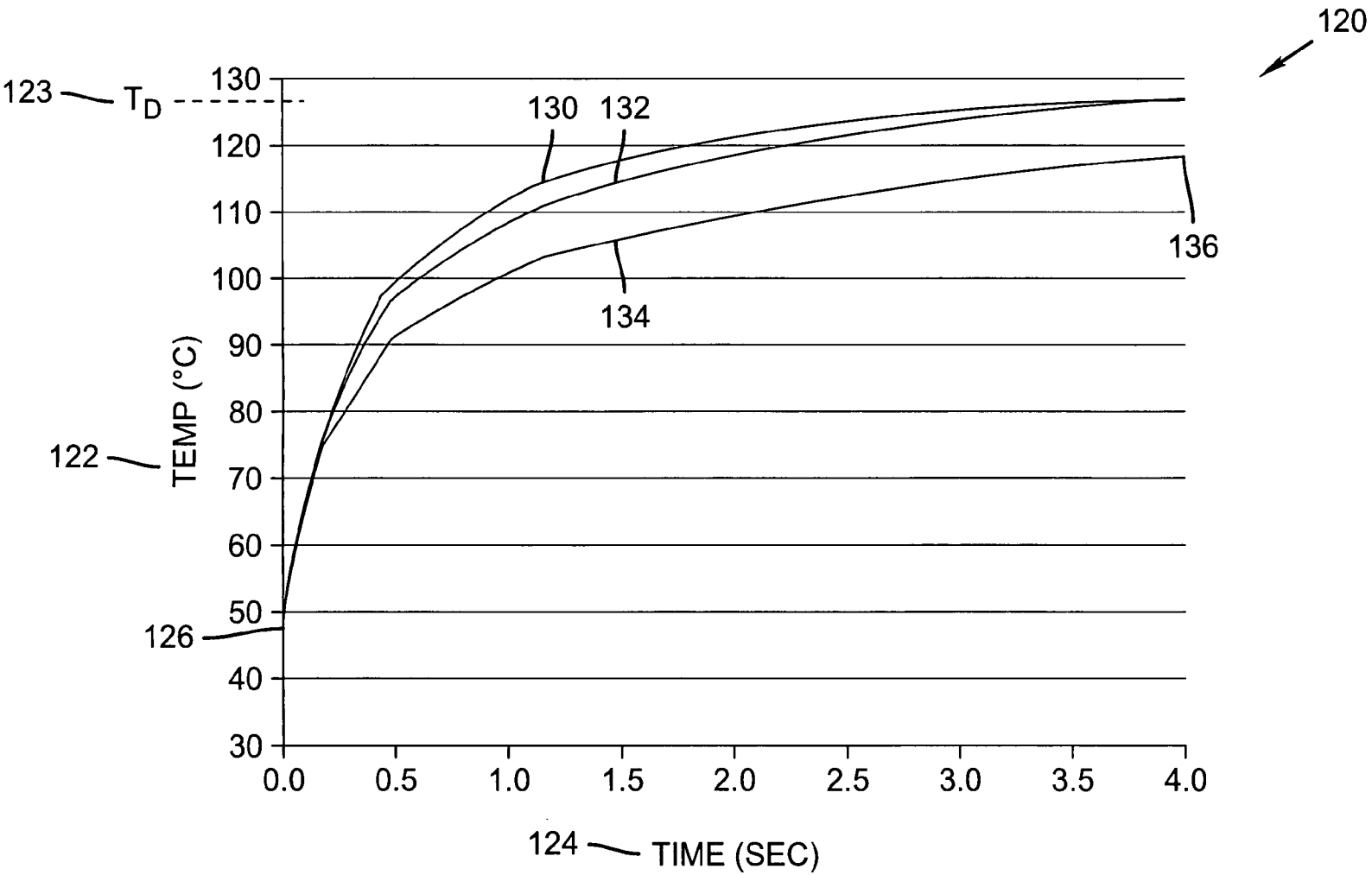
FIG. 3 is a graph illustrating temperature profile of imaging media heated by a drum-type thermal processor employing temperature compensation techniques according to embodiments of the present invention.

FIG. 3 is a graph 120 illustrating a simulation of the temperature profiles of the first and last sheets of a series of sheets of imaging media processed by thermal processor 30 and showing the effect of temperature compensation techniques of the present invention on the temperature profiles of the processed sheets. In the simulation illustrated by FIG. 3, a series of 50 sheets of imaging media was processed with a 4-second spacing maintained between sheets of the series. A development temperature of 128° C. and a temperature offset of 4° C. were employed, such that temperature controller 62 maintained a desired set-point temperature ranging between 128° C. and 132° C. based on temperature signal 64 provided by temperature sensor 60.

The temperature is illustrated along the y-axis, as indicated at 122, with development temperature ($T_D$) indicated at 123, and time (in seconds) is illustrated along the x-axis, as indicated at 124. At time equal to zero, as indicated at 126, the sheets of imaging media enter drum type processor 34 at a temperature of approximately 47° C. At time equal to 4 seconds, the sheets of imaging media exit from drum-type processor 34 to flatbed type processor 36. Curve 130 illustrates the temperature profile of the first sheet of imaging media of the series as it passes through and is thermally processed by thermal processor 30. Curve 134 illustrates the temperature profile of the final sheet of the series of sheet (i.e. the fiftieth sheet) when drum-type processor 34 employs the temperature compensation techniques as described above. For comparison, curve 134 illustrates the temperature profile of the final sheet of the series when drum-type processor 34 does not employ temperature compensation techniques.

As illustrated by FIG. 3, when drum-type processor 34 employs temperature compensation techniques according to the present invention, the temperature profile of the final sheet of the series (i.e. curve 134) more closely follows the temperature profile of the first sheet of the series (i.e. curve 130) than the temperature profile of the final sheet of the series (i.e. curve 134) when not employing temperature compensation. When drum-type processor 34 does not employ temperature compensation techniques, the temperature of the final sheet of the series does not reach development temperature upon exiting drum-type processor 34, as indicated at 136. By reducing variations between the temperature profiles of a series of thermally processed sheets of imaging media, thermal processor 30 employing drum-type processor 34 utilizing the temperature compensation techniques of the present invention reduces density variations in the resulting developed images.

Figure 4:
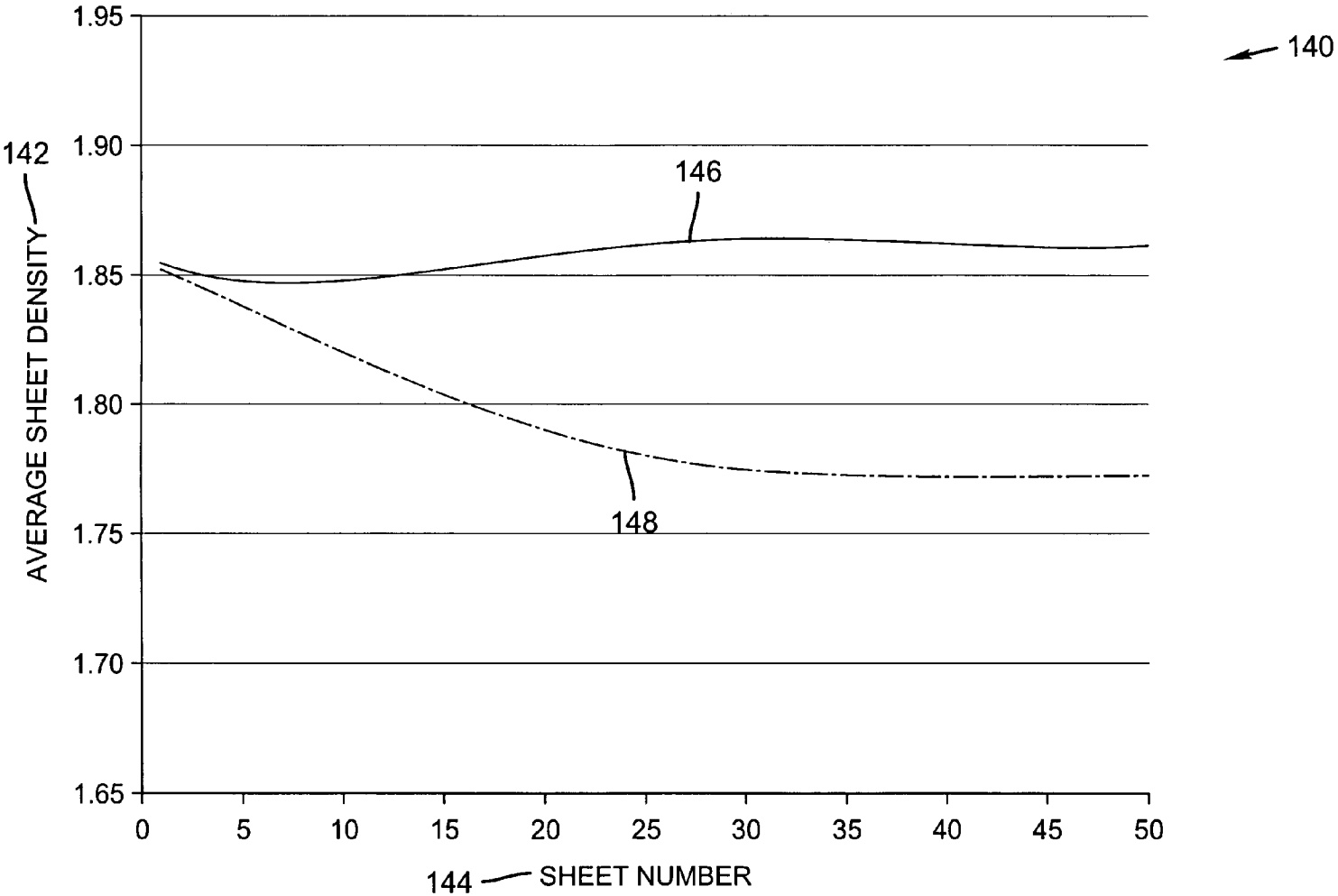
FIG. 4 is a graph illustrating average density levels of processed imaging media.

FIG. 4 is a graph 140 illustrating the increased consistency in density levels in a series of sheets of imaging media developed by thermal processor 30 when employing temperature compensation techniques according to embodiments of the present invention. The density level is illustrated along the y-axis, as indicated at 142, and the sheet number of the series is illustrated along the x-axis, as indicated at 144.

Curve 146 illustrates the average sheet density of the sheets of imaging media when thermal processor 30 employs temperature compensation according to embodiments of the present invention. In the illustrated example, a series of 50 sheets of 14"×17" imaging media were developed, wherein a 4-second gap was maintained between individual sheets of the series and an offset temperature ($T_{DO}$) of 4° C. was employed by temperature controller 62. As illustrated, the average density levels range between approximately 1.845 and 1.865, or a variance of approximately 1.1% from the lowest level. A difference between the average density levels of the first and last sheets of the series is approximately 0.01, or approximately 0.5%.

For comparison, curve 148 illustrates the average sheet density of a similar series of sheets of imaging media when thermal processor 30 does not employ temperature compensation (i.e $T_{DO}$=0). As illustrated, the average density levels range between approximately 1.770 and 1.855, or a variance of approximately 4.8% from the lowest level, which also coincides with the variance between the average density levels of the first and last sheets of the series.

Figure 5:
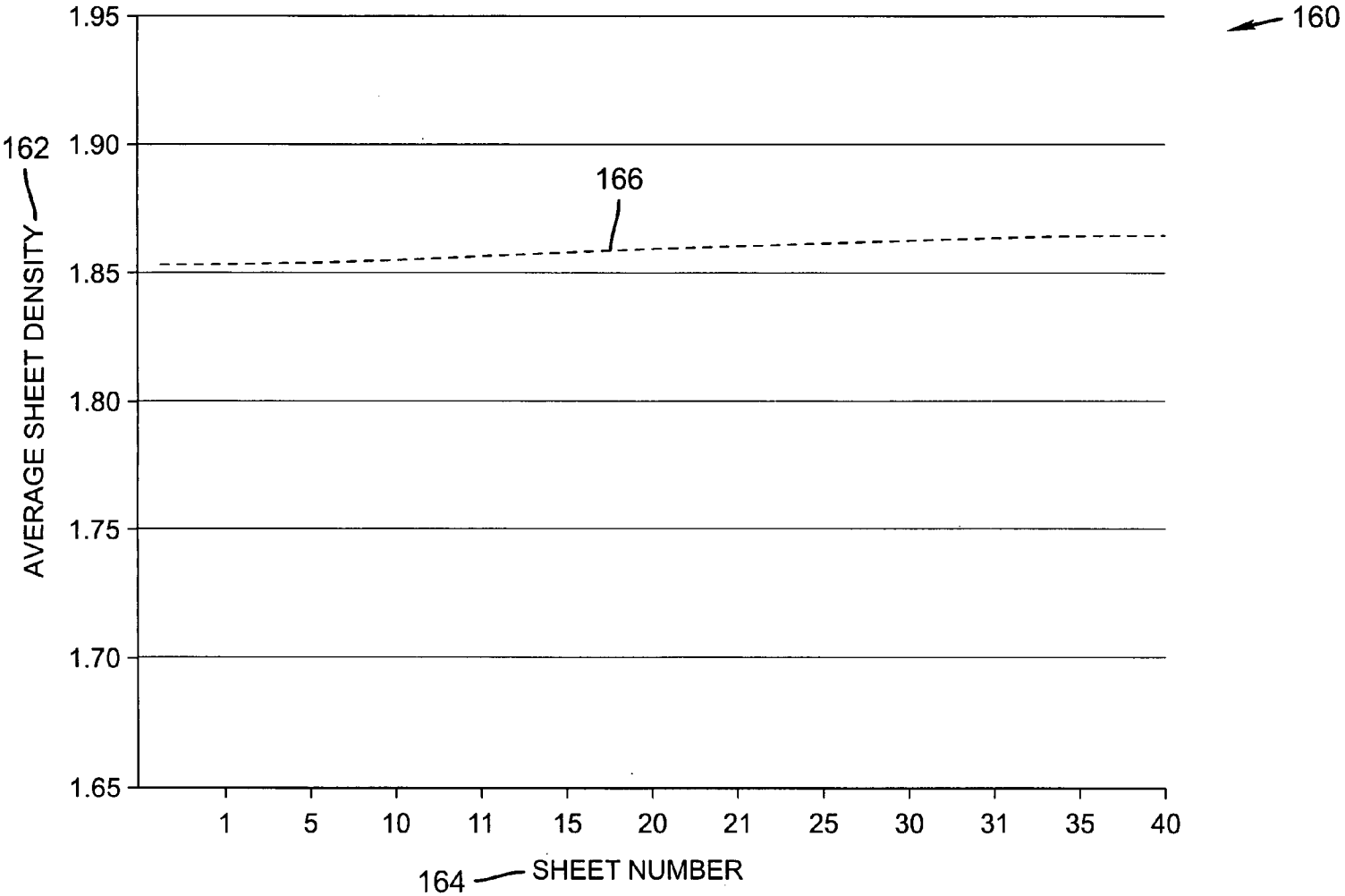
FIG. 5 is a graph illustrating average density levels of processed imaging media.

FIG. 5 is a graph 160 illustrating the average density levels of a series of 40, 14"×17" sheets of imaging media processed by thermal processor 30 employing temperature compensation techniques according to embodiments of the present invention. The x-axis (164) indicates the number of sheets. The y-axis (162) indicates the average sheet density. In the example of FIG. 5, the series of 40 sheets was separated into four groups of ten sheets, with a spacing of 4 seconds between each sheet of a group and a spacing of 1 minute between groups. As illustrated by curve 166, the average density levels range between approximately 1.855 and 1.865, or a variance of approximately 0.5% from the lowest level, which also coincides with the variance between the average density levels of the first and last sheets of the series.

As such, the temperature compensation techniques according to embodiments of the present invention are effective at reducing image density variations between sheets of imaging media for any number of combinations in which imaging media is fed into or processed by thermal processor 30. Additionally, although described herein with drum-type thermal processor 34 being employed together with flatbed type processor 36 to form thermal processor 30, it is noted that the temperature compensation techniques according to embodiments of the present invention may also be employed with stand-alone drum-type thermal processors.

The invention has been described in detail with particular reference to certain preferred embodiments thereof, but it will be understood that variations and modifications can be effected within the spirit and scope of the invention.

PARTS LIST

30 Thermal Processor
32 Imaging Media
34 Drum Type Processor
36 Flatbed Type Processor
38 Cooling Section
40 Processing Drum
42 Directional Arrow
44 Circumferential Heater
46 Silicon Layer
48 Plurality of Pressure Rollers
50 First Pressure Roller
52 Upper Cover
54 Lower Cover
56 Entrance
58 Guide Plate
59 Guide Plate
60 Temperature Sensor
62 Controller
64 Temperature Signal
66 Set-point Temperature
70 Rollers (70*a*-70*g*)
72 Idler Rollers (72*a*, 72*b*)
82 Heat Plate
84 Heater
86 Oven Plates (86*a*, 86*b*)
90 Upper Plurality of Rollers
92 Lower Plurality of Rollers
94 Roller Pair
96 Roller Pair
98 Exit
100 Transport Path
110 Graph
112 Set-Point Temperature Curve
114 Temp ($T_R$) (x-axis)
116 Set-point Temperature ($T_D$) (y-axis)
120 Graph
122 Y-axis (Temperature)
123 Development Temperature
124 X-axis (Time)
126 Zero Time
130 Temperature Profile Curve
132 Temperature Profile Curve
134 Temperature Profile Curve
136 Exit Temperature

140 Graph
142 Y-axis (Average Sheet Density)
144 X-axis (Sheet Number)
146 Average Sheet Density Curve
148 Average Sheet Density Curve
160 Graph
162 Y-axis (Average Sheet Density)
164 X-axis (Sheet Number)
166 Average Sheet Density Curve

What is claimed is:

1. A thermal processor comprising:

a rotating drum including an internal heater configured to heat and maintain the drum at a desired set-point temperature;

a plurality of pressure rollers, including a first pressure roller;

circumferentially spaced along a segment of the drum;

a temperature sensor configured to provide a temperature signal indicating a temperature of the first pressure roller; and a controller configured to adjust the desired set-point temperature based on the temperature signal.

2. The thermal processor of claim 1, wherein the controller is configured to increase the desired set-point temperature when the temperature signal indicates that the temperature is below a threshold level.

3. The thermal processor of claim 1, wherein the controller is configured to adjust the desired set-point temperature within a set-point temperature range having a low-end set-point temperature and a high-end set-point temperature.

4. The thermal processor of claim 3, wherein the low-end set-point temperature is substantially equal to a desired development temperature of an imaging media being processed by the thermal processor.

5. The thermal processor of claim 3, wherein the controller is configured to set the desired set-point temperature to the high-end set-point temperature when the temperature signal indicates that the temperature is less than or equal to a minimum threshold temperature, and to set the desired set-point temperature to the low-end set-point temperature when the temperature signal indicates that the temperature is greater than or equal to a maximum threshold temperature.

6. The thermal processor of claim 3, wherein the controller is configured to set the desired set-point temperature to a temperature between the high-end and low-end set point temperatures when the temperature signal indicates that the temperature is between the minimum and maximum threshold temperatures.

7. The thermal processor of claim 6, wherein the temperature controller is configured to upwardly adjust the desired set-point temperature within the set-point temperature range when a current value of the temperature signal indicates a temperature less than a temperature indicated by a preceding value of the temperature signal.

8. The thermal processor of claim 6, wherein the temperature controller is configured to downwardly adjust the desired set-point temperature within the set-point temperature range when a current value of the temperature signal indicates a temperature greater than a temperature indicated by a preceding value of the temperature signal.

9. The thermal processor of claim 1, wherein the temperature sensor comprises an infrared temperature sensor configured to provide a temperature of a surface of the first pressure roller.

10. The thermal processor of claim 1, wherein the temperature sensor comprises a thermocouple type temperature sensor positioned proximate to the first pressure roller and configured to provide a temperature of air proximate to the first pressure roller.

11. The thermal processor of claim 1, wherein the temperature sensor comprises a resistive-type temperature sensor.

12. The thermal processor of claim 1, wherein the temperature sensor is thermally isolated from other thermal processor components.

13. The thermal processor of claim 1, further including an enclosure spaced from and forming an oven about the drum and the plurality of pressure roller, the oven having an entrance, wherein the first pressure roller is positioned proximate to the entrance.

14. An imaging apparatus comprising:

a drum type processor configured to heat an exposed imaging media to a development temperature associated with the exposed imaging media;

the drum type processor including:

a rotating drum including an internal heater configured to heat and maintain the drum at a desired set-point temperature; and a plurality of pressure rollers, including a first pressure roller; circumferentially spaced along a segment of the drum; and a temperature sensor configured to provide a temperature signal indicating a temperature of the first pressure roller; and a controller configured to adjust the desired set-point temperature based on the temperature signal.

15. The imaging apparatus of claim 14, wherein the controller is configured to adjust the desired set-point temperature within a set-point temperature range having a low-end set-point temperature and a high-end set-point temperature.

16. The imaging apparatus of claim 14, further including a flatbed type processor configured to receive the exposed imaging media at the development temperature from the drum type processor and configured to maintain the exposed imaging media at the development temperature for a desired dwell time.

17. A method of operating a thermal processor having a heater configured to maintain a rotating drum at a desired set-point temperature and including a plurality of pressure rollers circumferentially spaced along a segment of the rotating drum, the method comprising:

measuring a temperature of a first pressure roller of the plurality of pressure rollers; and adjusting the desired set-point temperature based on the measured temperature.

18. The method of claim 17, wherein adjusting the desired set-point temperature includes adjusting the desired set-point temperature within a set-point temperature range having a low-end set-point temperature and a high-end set-point temperature.

19. The method of claim 18, wherein adjusting the desired set-point temperature includes:

setting the desired set-point temperature to the high-end set-point temperature when the temperature signal indicates that the temperature is less than or equal to a minimum threshold temperature, and to set the desired set-point temperature to the low-end set-point temperature when the temperature signal indicates that the temperature is greater than or equal to a maximum threshold temperature;

setting the desired set-point temperature to a temperature between the high end and low-end set point temperatures when the temperature signal indicates that the temperature is between the minimum and maximum threshold temperatures; and setting the desired set-point temperature to a temperature between the high end and low-end set point temperatures when the temperature signal indicates that the temperature is between the minimum and maximum threshold temperatures.

20. The method of claim 19, wherein adjusting the desired set-point temperature when the temperature is between the minimum and maximum threshold temperatures includes:

upwardly adjusting the desired set-point temperature within the set-point temperature range when a current value of the temperature signal indicates a temperature less than a temperature indicated by a preceding value of the temperature signal; and downwardly adjusting the desired set-point temperature within the set-point temperature range when a current value of the temperature signal indicates a temperature greater than a temperature indicated by a preceding value of the temperature signal.

* * * * *